US007431299B2

(12) United States Patent
Darling

(10) Patent No.: US 7,431,299 B2
(45) **Date of Patent: *Oct. 7, 2008**

(54) METHOD AND DEVICE FOR PLAYING A GAME USING REMAINDER VALUES

(76) Inventor: Richard Darling, 138 S. Zurich Ave., Egg Harbor City, NJ (US) 08215

( * ) Notice: Subject to any disclaimer, the term of this patent is extended or adjusted under 35 U.S.C. 154(b) by 390 days.

This patent is subject to a terminal disclaimer.

(21) Appl. No.: 11/203,766

(22) Filed: Aug. 15, 2005

(65) Prior Publication Data

US 2006/0038344 A1 Feb. 23, 2006

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS

| | | | | | |
|---|---|---|---|---|---|
| 3,661,392 | A * | 5/1972 | Abney | 273/293 |
| 4,173,834 | A * | 11/1979 | Arzola | 434/209 |
| 4,379,700 | A * | 4/1983 | Pollock | 434/208 |
| 4,452,588 | A * | 6/1984 | Smith | 434/207 |
| 5,083,793 | A * | 1/1992 | Sanford | 273/249 |
| 5,176,381 | A * | 1/1993 | Winters | 273/146 |
| 5,314,190 | A * | 5/1994 | Lyons | 273/272 |
| 5,632,486 | A * | 5/1997 | Mkrtchyan | 273/292 |
| 5,679,002 | A * | 10/1997 | Scelzo | 434/196 |
| 6,062,566 | A * | 5/2000 | Lemons | 273/293 |
| 6,089,871 | A | 7/2000 | Jaffe | 434/209 |
| 6,102,401 | A | 8/2000 | Segman et al. | 273/272 |
| 6,341,779 | B1 | 1/2002 | Merritt | 273/292 |
| 6,386,973 | B1 | 5/2002 | Yoseloff | 463/13 |
| 6,811,402 | B1 | 11/2004 | Ritchie | 434/191 |
| 7,097,174 | B2 * | 8/2006 | Darling | 273/292 |
| 7,243,919 | B2 * | 7/2007 | Ringuette | 273/299 |
| 2002/0096829 | A1 | 7/2002 | Lee et al. | 273/292 |
| 2005/0023761 | A1 | 2/2005 | Ringuette | 273/292 |
| 2005/0167923 | A1 | 8/2005 | Collins | 273/292 |
| 2005/0242503 | A1 | 11/2005 | Lloyd | 273/292 |

* cited by examiner

*Primary Examiner*—Gene Kim
*Assistant Examiner*—Dolores Collins
(74) *Attorney, Agent, or Firm*—Mathews, Shepherd, McKay & Bruneau, P.A.

(57) ABSTRACT

The present invention relates to a method of playing a game in which a guess is made of a number value of a remainder. A total point value is determined from game pieces given to a player. A number value of a remainder is determined by dividing the total point value by a predetermined divisor. The number value of the remainder is compared to the guessed number value of the remainder. If the number value of the remainder is the same as the guessed number value of the remainder, the player wins. In one embodiment, a bonus one or more bets can be placed on guesses of a last remaining remainder value determined upon continuation of the game, guesses of a value or a range of values of the total point value used for obtaining the last remaining remainder value or guesses of a value of a number of subsequent game pieces given to a player before the last remaining remainder value is determined.

20 Claims, 5 Drawing Sheets

METHOD AND DEVICE FOR PLAYING A GAME USING REMAINDER VALUES

CROSS REFERENCE TO RELATED APPLICATION

This application claims the benefit of U.S. patent application Ser. No. 10/922,468, filed Aug. 20, 2004, the entirety of which is hereby incorporated by reference into this application.

BACKGROUND OF THE INVENTION

1. Field of the Invention

The invention relates to games, such as a game in which a number value is determined as a remainder of a division of a total value of game pieces by a divisor and the number value is matched against a previous guess of the number value.

2. Description of Related Art

Variations in card games using card point values are known. In games such as black jack, a point value of cards is each player's hand is added together to determine the value of the hand after the player had the opportunity to be dealt additional cards. Different hands are compared to determine the winning hand, such as comparing the hand against the dealer hand.

U.S. Pat. No. 5,632,486 describes a method of playing a card game using a card number subtracting technique in which cards of the playing deck are assigned numerical point values. Eights, nines and tens are removed from the standard deck to establish a deck of forty cards. Each numbered card is assigned its point value. Each ace is assigned a value of one. Each face card is assigned a value of zero. Two cards are initially dealt to each player with each player having the option of receiving a third card. If a third card is dealt, one of the cards is discarded. The hands are compared to determine a winning hand as the hand in which the point value difference between the two cards in the hand is closest to zero.

Other games using multiplication and division concepts are known. U.S. Pat. No. 6,341,779 describes a mathematical card and dice game. The deck of cards includes cards having numeric values and cards having non-numeric values. The cards with non-numeric values are assigned numeric values. On a player's team, the player rolls the dice. Cards are removed from their hand by making mathematical relationships with the numbers on the dice which result in a value equal to the value of one or more cards in a player's hand.

It is desirable to provide a card game using simple mathematical concepts which is easy to play and provides increased player's interest.

SUMMARY OF THE INVENTION

The present invention relates to a method of playing a game in which a guess is made of a number value of a remainder. A total point value is determined from game pieces given to a player. A number value of a remainder is determined by dividing the total point value by a predetermined divisor. The number value of the remainder is compared to the guessed number value of the remainder. If the number value of the remainder is the same as the guessed number value of the remainder, the player wins. In one embodiment, one or more bets can be placed on guesses of the number value of the remainder. A payout can be paid for winners having a bet placed on a guessed number value of the remainder which matches the determined number value of the remainder.

In one embodiment, a bonus one or more bets can be placed on guesses of a last remaining remainder value determined upon continuation of the game, guesses of a value or a range of values of the total point value used for obtaining the last remaining remainder value or guesses of a value of a number of subsequent game pieces given to a player before the last remaining remainder value is determined.

The invention will be more fully described by reference to the following drawings.

DETAILED DESCRIPTION

Figure 1:
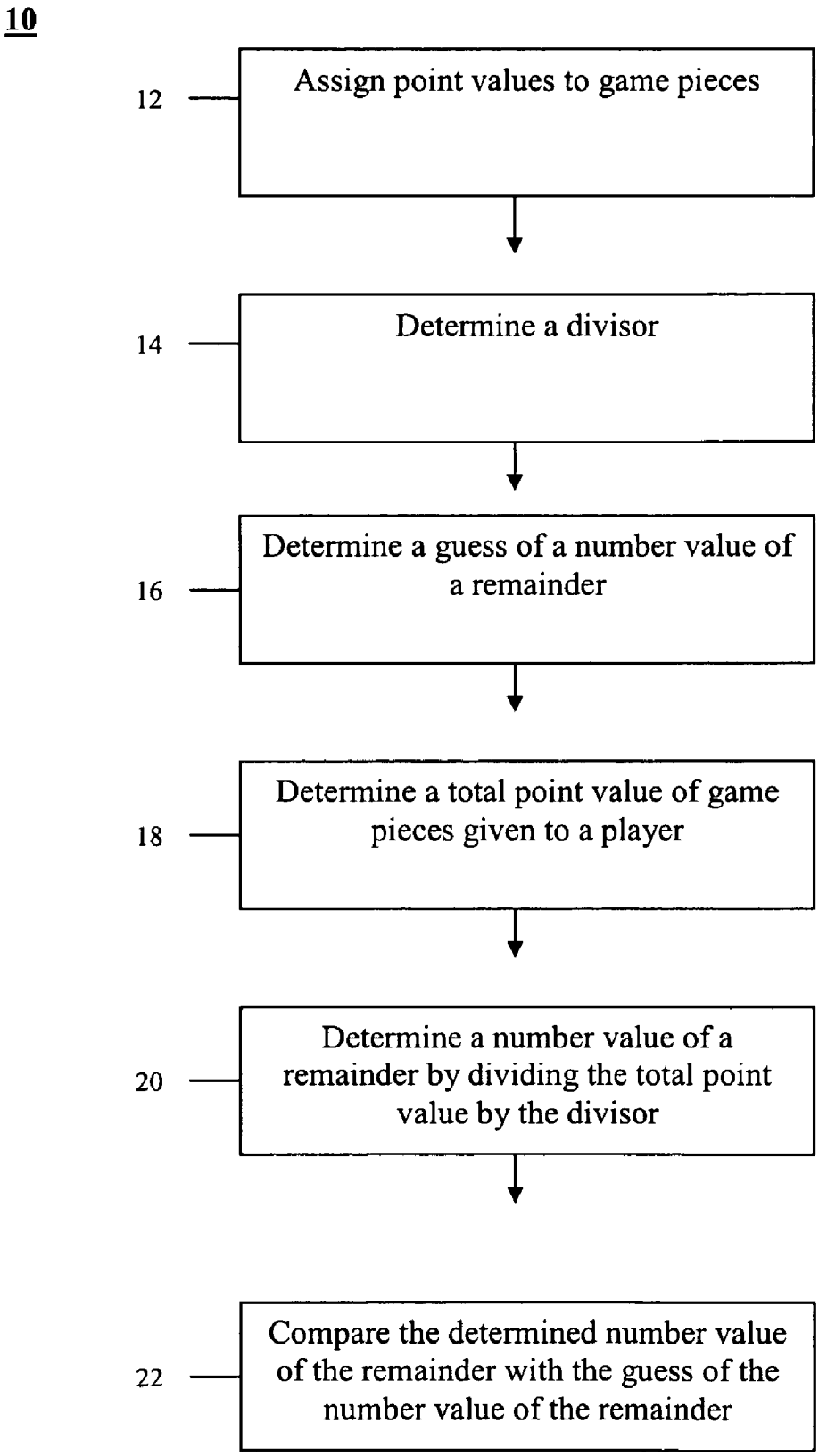
FIG. 1 is a flow diagram of a method of playing a card game using remainder values in accordance with the teachings of the present invention.
Figure 2:
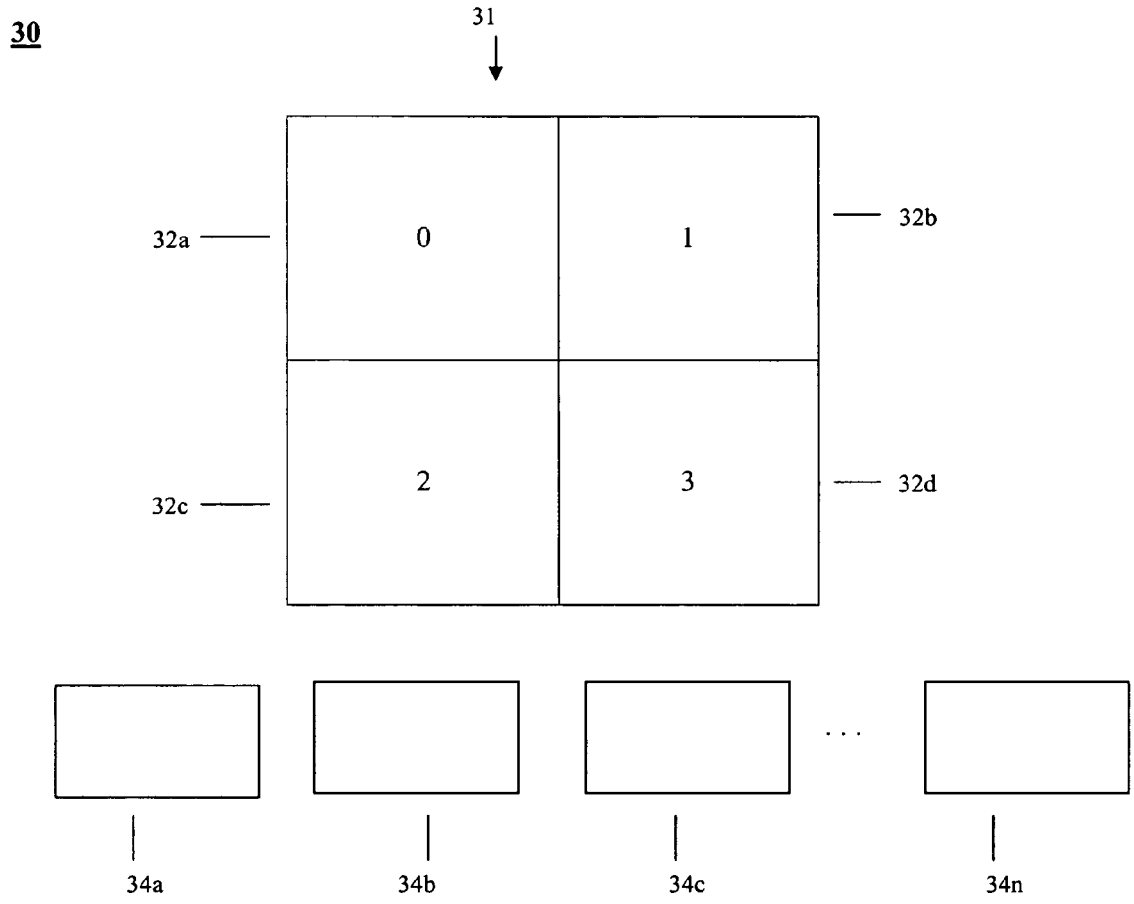
FIG. 2 is a schematic diagram of a device which can be used with the game of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a flow diagram of a method of playing a card game using remainder values 10. In block 12, point values are assigned to game pieces. In one embodiment, one or more conventional decks of 52 cards can be used as game pieces. Each type of card is assigned a point value. In one embodiment, the value of numeric cards 2 through 9 are assigned the same numeric point values shown on the face of the card, i.e., a two of any suit is assigned the point value of 2, a three of any suit is assigned the point value of 3, a four of any suit is assigned the point value of 4, a five of any suit is assigned the point value of 5, a six of any suit is assigned the point value of 6, a seven of any suit is assigned the point value of 7, an eight of any suit is assigned the point value of 8, and a nine of any suit is assigned the point value of 9. An ace of any suit is assigned the value of 1. Each of the face cards of any suit, such as Jack, Queen and King, is assigned the point value of 10. Alternatively, each of the face cards of any suit can be assigned a different point value, such as each Jack being assigned a point value of 11, each Queen being assigned a point value of 12 and each King being assigned a point value of 13.

In an alternate embodiment, Mah Jongg tiles can be used as game pieces. A number of Mah Jongg tiles are dealt to a player. Each of the Mah Jongg tiles is assigned the same point value as the values on the face of the Mah Jongg tiles.

Alternatively, the game pieces can be one or more dominoes or die. The assigned point values of the game pieces are determined by the corresponding numbers of dots or numbers on the game pieces. In one embodiment, a predetermined number of dice are rolled for each player. For example, the number of dice can be two through six die.

A value for a divisor is selected in block 14. For example, a value for the divisor can be 2, 3, 4, or 5.

In block 16, a guess of a number value of a remainder is determined. The number value of the remainder can be values between zero and one less than the value of the selected divisor. For example, a value for a guess can be 0, 1, 2, 3, or 4.

In block 18, a total point value of game pieces given to a player is determined. In one embodiment, a number of cards are dealt to each player. For example, the number of cards can be three, four or five cards. The total point value of the dealt cards is determined. For example, if three cards were dealt having values of 4, 7 and 10 of the total point value is 21. The total point value of the point values of the dealt Mah Jongg tiles is determined. In the alternative, the total point value of the upward face for all of the rolled die or dealt dominos is determined.

The divisor is divided into the total point value to determine a number value of a remainder, in block 20. If the divisor is evenly divided into the total point value of the game pieces, the remainder is zero. If the divisor is not evenly divided into the total value, the remainder can be a value greater than zero. For example, if the divisor is four, the remainder can be zero, one, two or three. In the above-described example having a total point value of 21, if the value of the divisor is selected to be four, the remainder will be one (21/4).

In block 22, the determined number value of the remainder is compared with the guess of the number value of the remainder. If the determined number value of the remainder matches the guess of the number value of the remainder, the player is a winner.

Betting can take place on the guess of a number value of the remainder prior to game pieces being handed out to a player. In one embodiment, device for playing a game 30 includes betting board 31. Betting board 31 can be a game table. Betting board 31 is partitioned into portions 32*a*-32*d*. It will be appreciated that the number of portions 32 corresponds to the possible number of remainder values. Each portion 32*a*-32*d* corresponds to a guess of a number value of the remainder. For example portion 32*a* corresponds to a guess of 1; portion 32*b* corresponds to a guess of 2; portion 32*c* corresponds to 3; and portion 32*d* corresponds to 4. A player places a wager of any amount on one or more of portions 32*a*-32*d* corresponding to a guess of the remainder value. A divisor is selected by the dealer or a player or preselected by the house. Game pieces are dealt to one or more players at dealer stations 34*a*-34*n*. The number value of a remainder is determined by dividing a total point value of the game pieces for each of the dealt hands by the divisor. A player wins a bet if a bet was placed on a portion 32*a*-32*d* corresponding to the guess of the number value of the remainder which matches the determined number value of the remainder.

Figure 3:
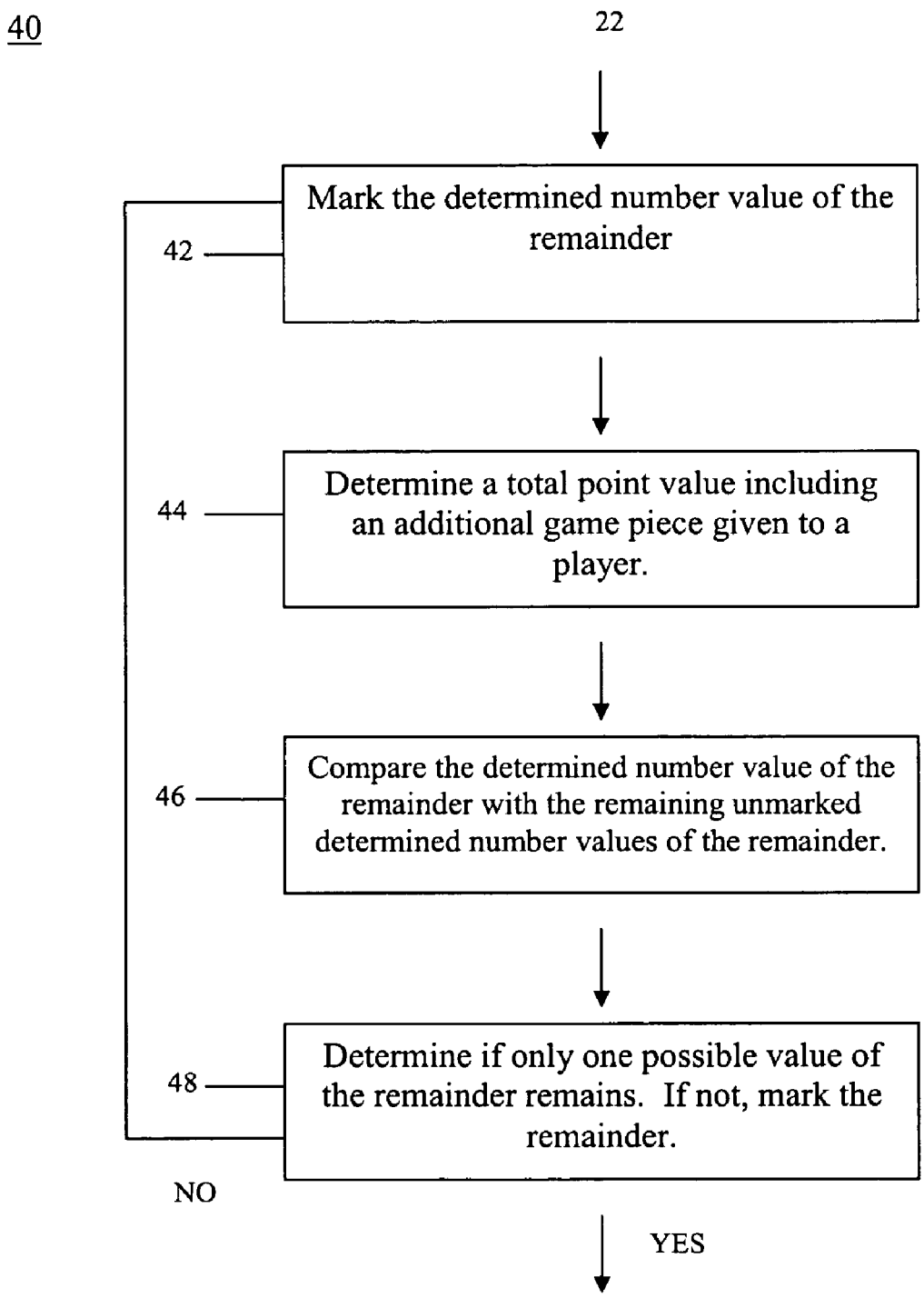
FIG. 3 is a flow diagram of a method of playing a card game using remainder values.

FIG. 3 is a flow diagram of a method of playing a card game using remainder values 40. After blocks 12 through 22 described above are performed, the determined number value of the remainder is marked in block 42. In block 44, a second total point value is determined after a subsequent game piece is given to a player. In block 46, the determined number value of the remainder is compared to remaining unmarked determined number values of the remainder. In block 48, it is determined if only one of the possible values of the remainder remains. If more than one possible value of the remainder remains, the remainder is marked and blocks 42-48 are repeated. If no other possible values of the remainder remain, the last determined remainder value is considered the winner.

Figure 4:
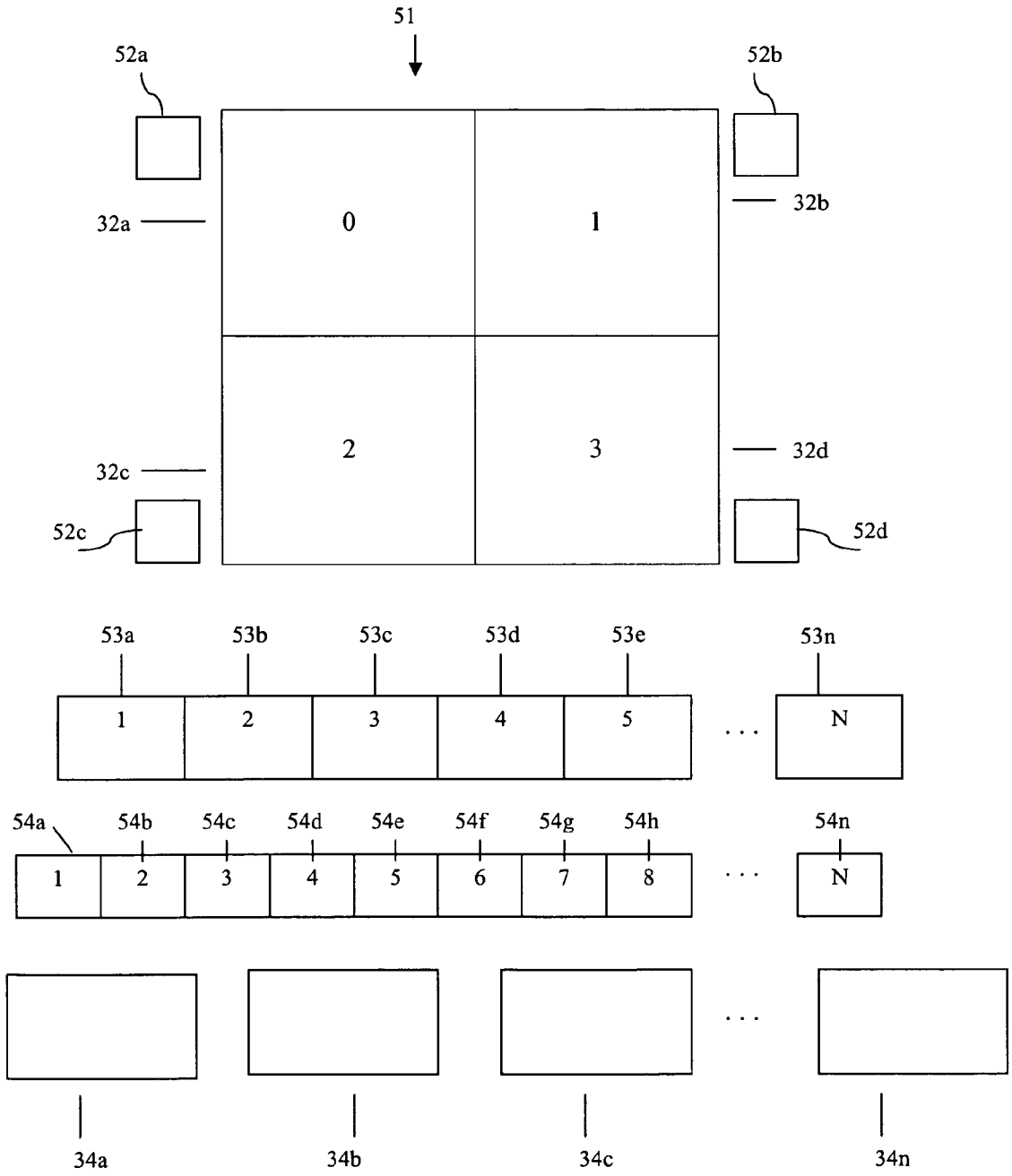
FIG. 4 is a schematic diagram of a device which can be used with the game of the present invention.

FIG. 4 is a device for playing a game including a betting board 51 which can be used with method 10 and method 40. A bonus wager of any amount can be placed on one or more portions of 52*a*-52*d* corresponding to the last remaining unmarked value of the remainder. A bonus wager of any amount can be placed on one or more of portions 53*a*-53*n* corresponding to the number of additional cards given to a player before only one of possible values of a remainder remains. For example, n can be ten cards. Alternatively, a wager can be placed on one or more of portions 54*a*-54*n*, corresponding to a guess number value or a range of values of the total point value used for obtaining the last determined value of the remainder.

Figure 5:
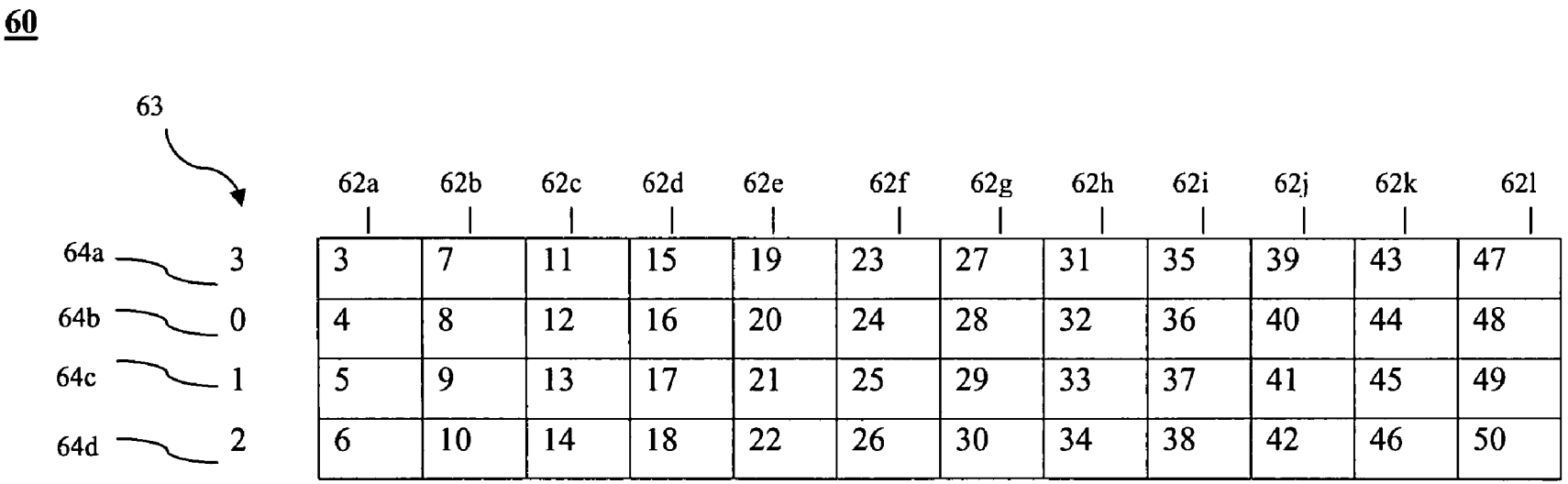
FIG. 5 is a schematic diagram of a device which can be used to determine remainder values.

In one embodiment, grid 60 of values can be used to determine remainder values and which of the possible guesses of a remainder remains, as shown in FIG. 5. In this example, grid 60 relates to a remainder used for a divisor of four. Columns 62*a*-62*l* of grid 60 includes possible total point values of the dealt game pieces. Column 63 represents possible remainder values. The remainder values of column 63 can total point values of columns 62*a*-62*l* can be marked after each determination of the remainder. For example, by placing a chip in column 63 in one of rows 64*a*-64*d* corresponding to the determined remainder value and a chip in one of columns 62*a*-62*l* in one of rows 64*a*-64*d* corresponding to the total point value of the game pieces used for determining the remainder value. For example, if game pieces having a total point value of 8 are dealt to a player, the total value of 8 is located in column 62*b* and row 64*b* and it is shown to correspond to column 63 and row 64*b* having a remainder value of 0. The total point value of 8 in column 62*b* and row 64*b* can be marked and the remainder value of 0 in column 63 and row 64*b* can be marked. Thereafter, another value of the total number of game pieces can be determined and the remainder value marked until only one value of the remainder remains in column 63.

In one embodiment, one or more portions 32*a*-32*n*, 34*a*-34*n*, 52*a*-52*n*, 53*a*-53*n*, 54*a*-54*n* and grid 60 are found and displayed electronically on a touch screen.

A winning matched guessed value of the remainder earns the player a predetermined payout. For example, the payout can be equal to the amount bet or can be greater than the amount bet, such as paying out 3 to 1 odds. In one embodiment, the payout is based at least in part on the probability of the guessed value of the remainder. In one embodiment, the odds of winning the game may be made more in favor of the house. For example, a winning player will be paid less than the true odds of the bet in order to allow the house or casino to profit from hosting the game.

In another embodiment, the house can take a commission on all winning players, for example, 5% of the winnings. In another embodiment, a certain total point value will not payout the bet even if a number value of a remainder is matched.

In one embodiment, each player is dealt the game pieces. Alternatively, only one hand of game pieces is dealt and one or more players can bet against the dealt hand of game pieces.

In one embodiment, the game is played in a casino. Alternatively the game can be played on a video screen or over the Internet.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A method of playing a game comprising the steps of:

a) guessing a number value of a remainder;

b) determining a total point value of game pieces given to a player;

c) determining a number value of a remainder by dividing the total point value by a predetermined divisor;

d) marking the determined number value of the remainder;

e) determining a subsequent total point value of a subsequent game piece given to a player plus the previous total point value;

f) determining a number value of a second remainder by dividing the second total point value by the predetermined divisor;

g) comparing the determined number value of the second remainder with remaining values of the remainder which were not marked in step d); and repeating steps d) through g) until only one remaining remainder which was not marked in step d) is determined to determine a final unmarked remainder, wherein the value of the final unmarked remainder is considered a winner of the game.

2. The method of claim 1 wherein the game pieces are one or more cards of a deck of 52 cards, each type of card is assigned a point value and the total point value being a total of the assigned point values.

3. The method of claim 2 wherein the assigned point value of numeric cards 2 through 9 in the deck is a respective value of the numeric cards.

4. The method of claim 2 wherein the assigned point value of each face card in the deck is a value of 10.

5. The method of claim 2 wherein the assigned point value of each face card in the deck is a value of 11 for a Jack, a value of 12 for a Queen and a value of 13 for a King.

6. The method of claim 2 wherein the assigned point value of each Ace in the deck is 1.

7. The method of claim 1 wherein the game pieces are one or more die, each face of the die is assigned a point value equaling the dots, the total point value being a total of the assigned point values for an upward face of each of the one or more die.

8. The method of claim 1 wherein the game pieces are one or more Mah Jongg tiles, each type of Mah Jongg tile is assigned a point value being determined from symbols on the Mah Jongg tile, the total point value being a total of the assigned point values.

9. The method of claim 1 wherein the game pieces are one or more dominos, each face of the dominos is assigned a point value equaling the dots, the total point value being a total of the assigned point values for an upward face of each of the one or more dominos.

10. The method of claim 1 wherein one or more bets are placed on a guess of the value of the final unmarked remainder and a payout is paid if the determined final unmarked remainder is the same as the guess of the value of the final unmarked remainder.

11. The method of claim 10 wherein the payout is based at least in part on a probability of obtaining the guessed value of the final unmarked remainder.

12. The method of claim 10 wherein the payout is equal to an amount of the bet.

13. The method of claim 10 wherein the payout is greater than an amount of the bet.

14. The method of claim 10 wherein a preselected said total point value will not provide said payout even if the determined remainder is the same as the guess of the value of the remainder.

15. The method of claim 1 wherein one or more bets are placed on a guess of a value of a number of subsequent game pieces given to a player before the final unmarked remainder is determined.

16. The method of claim 1 wherein one or more bets are placed on a guess of a number value or a range of number values corresponding to the second total point value used when the final unmarked remainder is determined.

17. The method of claim 1 wherein one or more bets are placed on the guess of the number value of the remainder and a payout is paid if the determined number values of the remainder is the same as the guess of the number value of the remainder.

18. The method of claim 1 wherein the game is played in a casino.

19. The method of claim 1 wherein the game is played on a video machine.

20. The method of claim 1 wherein the game is played over the Internet.

* * * * *